US007145419B2

(12) United States Patent
Kim

(10) Patent No.: US 7,145,419 B2
(45) Date of Patent: Dec. 5, 2006

(54) CONTACTOR ASSEMBLY FOR A CIRCUIT BREAKER

(75) Inventor: Yong-Gi Kim, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 4 days.

(21) Appl. No.: 11/239,049

(22) Filed: Sep. 30, 2005

(65) Prior Publication Data

US 2006/0077022 A1 Apr. 13, 2006

(30) Foreign Application Priority Data

Oct. 7, 2004 (KR) ..... 10-2004-0079829

(51) Int. Cl.
*H01H 75/00* (2006.01)

(52) U.S. Cl. ..... 335/16; 335/195; 218/22

(58) Field of Classification Search ..... 335/16, 335/147, 195; 218/22
See application file for complete search history.

(56) References Cited

U.S. PATENT DOCUMENTS 6,262,642 B1 * 7/2001 Bauer ..... 335/16
6,403,909 B1 * 6/2002 Green et al. ..... 218/22
6,791,440 B1 * 9/2004 Harmon et al. ..... 335/16
2005/0231308 A1 10/2005 Kim

OTHER PUBLICATIONS

U.S. Appl. No. 11/294,548 to Park., filed Dec. 6, 2005.

* cited by examiner

*Primary Examiner*—Lincoln Donovan
(74) *Attorney, Agent, or Firm*—Greenblum & Bernstein, P.L.C.

(57) ABSTRACT

A contactor assembly for a circuit breaker comprises a first spring supporting pin, a cam plate, a second spring supporting plate, a link, and a spring. When a movable contactor is rotated without a rotation axis, a fluctuation of a rotation center of the movable contactor is not generated and a current limiting function is fast performed. Also, after contacts are separated from each other, the movable contactor is prevented from returning towards fixed contactors and the separated position is maintained for a predetermined time. An assembly process of the contactor assembly is simplified.

7 Claims, 8 Drawing Sheets

CONTACTOR ASSEMBLY FOR A CIRCUIT BREAKER

BACKGROUND OF THE INVENTION

1. Field of the Invention

The present invention relates to a circuit breaker for protecting an electric circuit and electric load equipments by automatically breaking the circuit at the time of occurrence of an overload or a short circuit, and more particularly, to a contactor assembly for such a circuit breaker.

2. Description of the Background Art

A mold cased circuit breaker (MCCB) is installed at an electric power distributing board among several electric power systems of a factory and a building. The circuit breaker serves as a switch for supplying or cutting off electric power source to a load side under no load state, and cuts off power supplied to a load side from a power side in order to protect a circuit and electric load equipments when a great abnormal current due to a short-circuit or a ground fault flows on a circuit under a load state.

FIG. 1 is a sectional view showing an inner construction of a circuit breaker in accordance with the conventional art, and FIG. 2 is a frontal view of a movable contactor assembly of the circuit breaker in accordance with the conventional art, which shows a closed circuit state, and FIG. 3 is a frontal view of the movable contactor assembly of the circuit breaker in accordance with the conventional art, which shows an opened circuit state.

As shown, a circuit breaker 1 comprises a mold case 10, fixed contactors 9 and 9' installed in the mold case 10 with a predetermined distance, a movable contactor assembly 17 rotatably disposed between the fixed contactors 9 and 9', a trip mechanism 11 for tripping the circuit breaker by detecting a large current, a switching mechanism 12 automatically operated by the trip mechanism 11 or manually operated by operating a switching handle 1, for separating a movable contactor 4 from the fixed contactors 9 and 9' thereby cutting off a circuit, and an arc extinguishing mechanism 13 for extinguishing arc gas of a high temperature and a high pressure generated between a contact 4*b* of the movable contactor 4 and contacts 9*b* and 9*b*' of the fixed contactors 9 and 9' at the time of switching a circuit.

The mold case 10 is provided with the above mechanisms therein, and is formed of an insulating material to insulate the mechanisms of phases, and to prevent foreign materials such as dust from being introduced into the mold case 10.

The fixed contactors, that is, a fixed contactor 9 for connecting a power source and a fixed contactor 9' for connecting an electric load are respectively provided with a contact 9*b* and a contact 9*b*' at the end thereof. The movable contactor 4 is provided with a contact 4*b* at both ends thereof.

The movable contactor assembly 17 comprises a movable contactor 4 rotatably positioned between the fixed contactors 9 and 9' for maintaining a closed state or an opened state, a rotation shaft 2 for supporting the movable contactor 4 rotatably, and a pair of springs 15 and 16 respectively having one ends 15*a* and 16*a* fixed to the movable contactor 4 and the other ends 15*b* and 16*b* fixed to the rotation shaft 2 for elastically rotating the movable contactor 4 centering around a virtual rotation axis 2*a* by an electromagnetic repulsive force generated at the contacts 9*b* and 9*b*' when a large current flows on a circuit due to a short-circuit or a ground fault. The method for supporting the movable contactor 4 to the rotation shaft 2 centering around the virtual rotation shaft 2*a* is called as a self centering.

As shown in FIG. 2, a state that the contact 4*b* of the movable contactor 4 is in contact with the contacts 9*b* and 9*b*' of the fixed contactors 9 and 9' is called as 'a closed circuit state'. As shown in FIG. 3, a state that the contact 4*b* of the movable contactor 4 is separated from the contacts 9*b* and 9*b*' of the fixed contactors 9 and 9' is called as 'an opened circuit state'. Also, converting the closed circuit state to the opened circuit state is called as 'separating and opening'.

The movable contactor 4 is supported by the pair of springs 15 and 16 disposed to be symmetrical to each other centering around the virtual rotation axis 2*a*.

One ends 15*a* and 16*a* of the springs 15 and 16 are fixed to the movable contactor 4, and the other ends 15*b* and 16*b* thereof are fixed to the rotation shaft 2. Accordingly, as shown in FIG. 2, when a normal current flows on a circuit, the contact 4*b* of the movable contactor 4 is in contact with the contacts 9*b* and 9*b*' of the fixed contactors 9 and 9' thereby to maintain a closed circuit state. Under the state, the springs 15 and 16 provide an elastic force to the movable contactor 4 so that the movable contactor 4 can be maintained in contact with the fixed contactors 9 and 9'. Accordingly, an electric current flows from the fixed contactor 9 to the fixed contactor 9' through the movable contactor 4.

As shown in FIG. 3, when a large current flows on a circuit due to a short-circuit or a ground fault, the movable contactor 4 is separated from the fixed contactors 9 and 9' by an electromagnetic repulsive force between the contact 4*b* of the movable contactor 4 and the contacts 9*b* and 9*b*' of the fixed contactors 9 and 9' thereby to have a rotation moment. Accordingly, the movable contactor 4 overcomes an elastic force of the springs 15 and 16, and rotates in a clockwise direction thereby to cut off the circuit. An unexplained reference numeral 18 designates a stopper for limiting a rotation range of the movable contactor 4.

The conventional movable contactor assembly of a circuit breaker has the following problems. When the movable contactor 4 is separated from the fixed contactors 9 and 9', the virtual rotation axis 2*a* of the movable contactor 4 is not stable, so it cause to generate a fluctuation of the movable contactor 4 in right and left directions and up and down directions. Also, when the movable contactor 4 is separated from the fixed contactors 9 and 9', an elastic restoration force of the springs 15 and 16 increases and thereby the movable contactor 4 becomes in contact with the fixed contactors 9 and 9' again due to the restoration force. That causes a re-contact between the contacts at the time of a short-circuit and a re-separation by an electromagnetic repulsive force, thereby continuously generating an arc. Accordingly, an instant current limiting characteristic is not obtained and severe damages may be caused to the circuit breaker and the load devices.

BRIEF DESCRIPTION OF THE INVENTION

Therefore, an object of the present invention is to provide a contactor assembly for a circuit breaker capable of preventing a movable contactor from generating a fluctuation at a center thereof when the movable contactor rotates without a rotation axis, capable of fast performing a current limiting function, capable of preventing the movable contactor separated from a fixed contactor from returning to a contact state to the fixed contactor for a predetermined time, and capable of facilitating an assembly thereof.

To achieve these and other advantages and in accordance with the purpose of the present invention, as embodied and broadly described herein, there is provided a contactor assembly for a circuit breaker comprising: a U-shaped first fixed contactor connected to a power source on a circuit; a U-shaped second fixed contactor connected to an electric load on the circuit; a movable contactor having contacts at both ends thereof, the contacts respectively corresponding to the first fixed contactor and the second fixed contactor, and movable to a contacted position to the first and second fixed contactors or a separated position from the first and second fixed contactors; a shaft provided with an opening for allowing independent rotating of the movable contactor by an electromagnetic repulsive force between the movable contactor and the first and second fixed contactors, for rotatably supporting the movable contactor; a pair of first spring supporting pins symmetrically fixed on both lateral surfaces of the movable contactor; a cam plate positioned between the movable contactor and the shaft, fixed to the shaft, and having an outer circumferential surface formed as a cam surface composed of a plurality of arc surfaces having different centers and radiuses, wherein the cam surface includes a first cam surface having an arc center positioned at an inner side of the outer circumferential surface, a second cam surface having an arc center positioned at an outer side of the outer circumferential surface, and a third cam surface disposed between the first cam surface and the second cam surface, the third cam surface having an arc center positioned at an inner side of the outer circumferential surface; a pair of symmetric second spring supporting pins contacting the first cam surface of the cam plate when the movable contactor is in contact with the first and second fixed contactors, and rotated along the movable contactor being rotated when an electromagnetic repulsive force is generated between the movable contactor and the first and second fixed contactors thereby to be slid on the third cam surface from the first cam surface of the cam plate and thus to be in contact with the second cam surface for a predetermined time, for preventing the movable contactor from returning towards the first and second fixed contactors; a link for connecting the first spring supporting pins to the second spring supporting pins; and a spring having one end supported by the first spring supporting pins and the other end supported by the second spring supporting pins, for providing an elastic force so that a contact pressure between the movable contactor and the fixed contactors can be maintained under a state that the movable contactor is in contact with the first and second fixed contactors, and for providing an elastic force in a direction to accelerate a separation of the movable contactor from the first and second fixed contactors when the second spring supporting pins are slid on the third cam surface as an electromagnetic repulsive force is generated between the movable contactor and the first and second fixed contactors.

The foregoing and other objects, features, aspects and advantages of the present The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 9 to 11 are sectional views showing an operation state of a movable contactor of the present invention, in which FIG. 9 shows a state that contacts are in contact with each other (a closed circuit state);

FIG. 10 shows a state that the contacts are being separated from each other (an opening circuit state); and FIG. 11 shows that the separation of the movable contactor from the fixed contactors is completed.

DETAILED DESCRIPTION OF THE INVENTION

Reference will now be made in detail to the preferred embodiments of the present invention, examples of which are illustrated in the accompanying drawings.

Hereinafter, a contactor assembly for a circuit breaker according to the present invention will be explained in more detail with reference to the attached drawings.

Figure 1:
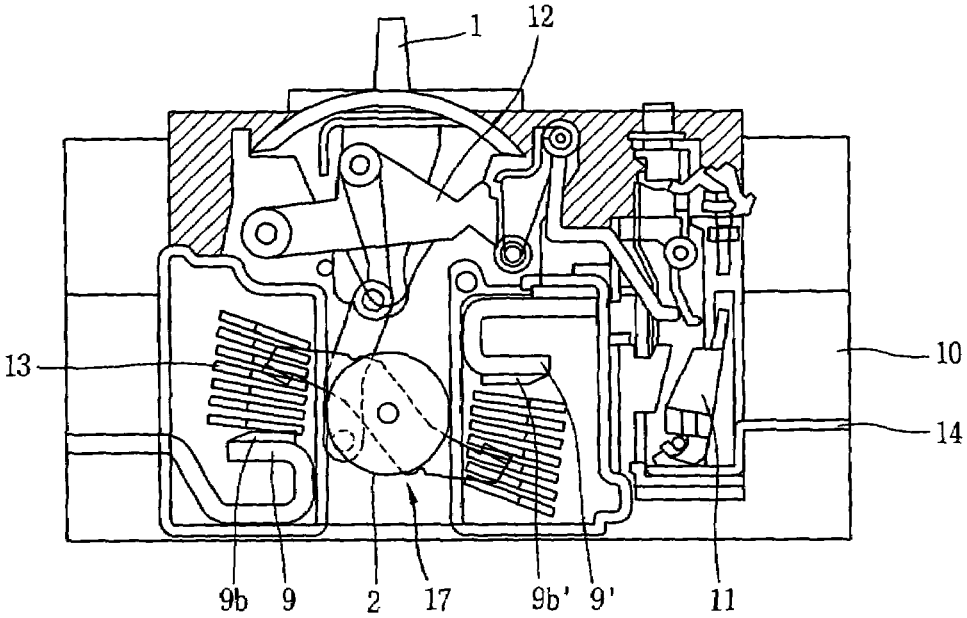
FIG. 1 CONVENTIONAL ART
FIG. 1 is a sectional view showing an inner construction of a circuit breaker in accordance with the conventional art.
Figure 2:
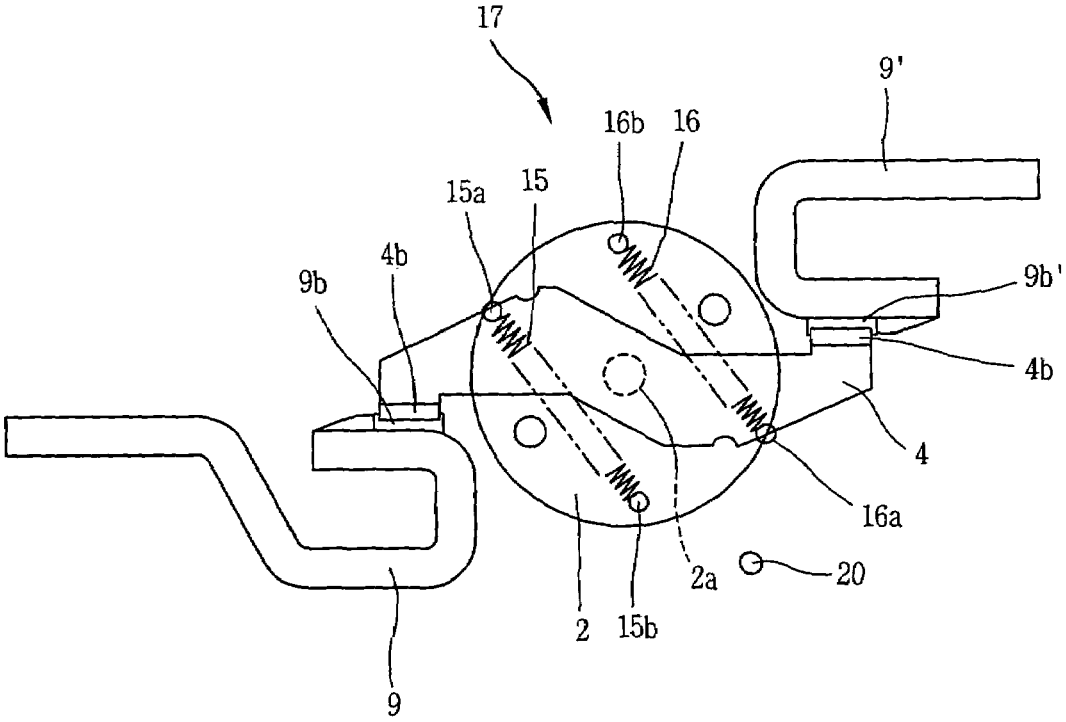
FIG. 2 CONVENTIONAL ART
FIG. 2 is a frontal view of a movable contactor assembly for the circuit breaker in accordance with the conventional art, which shows a closed circuit state (contacts are in contact with each other)
Figure 3:
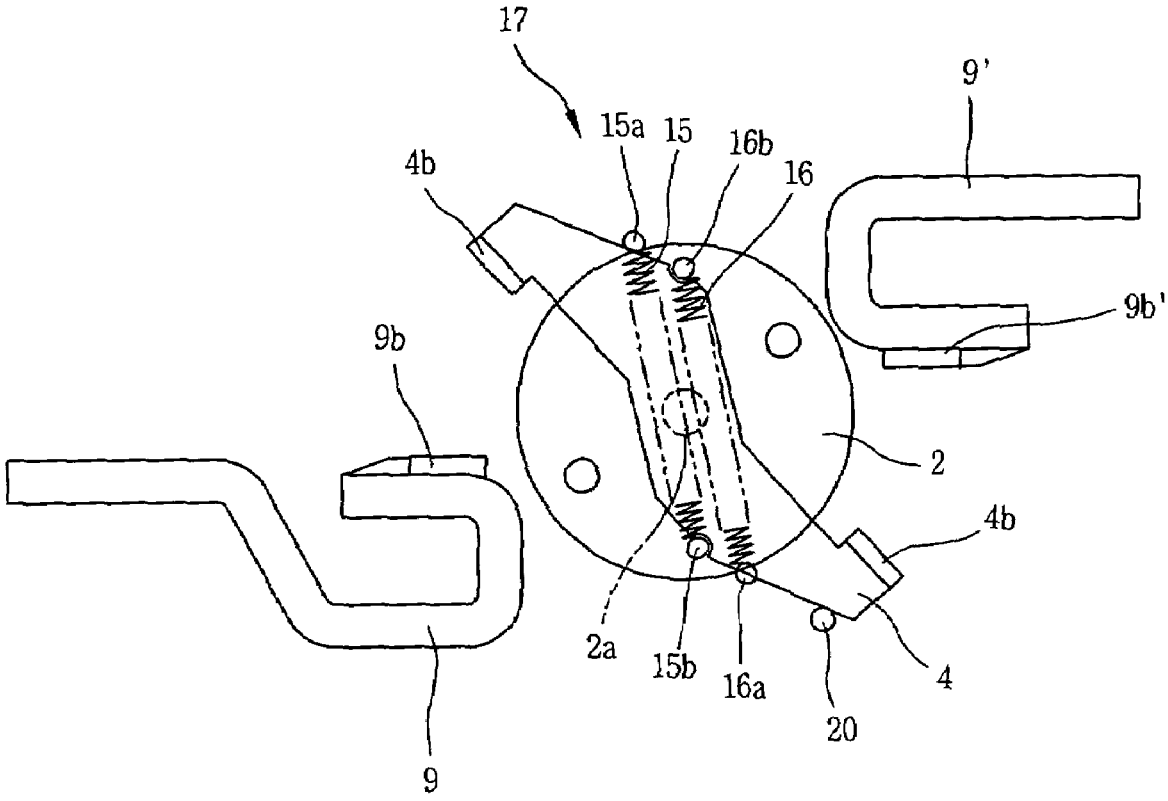
FIG. 3 CONVENTIONAL ART
FIG. 3 is a frontal view of the movable contactor assembly for the circuit breaker in accordance with the conventional art, which shows an opened circuit state (contacts are separated from each other)
Figure 4:
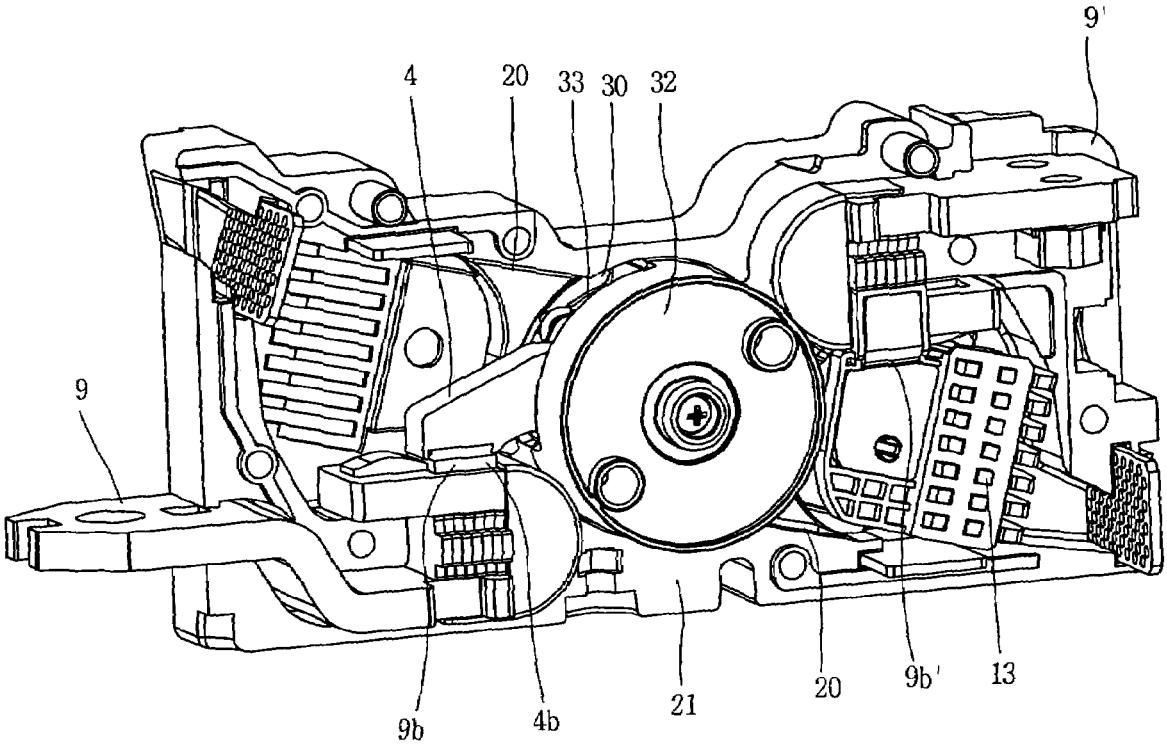
FIG. 4 is a cut-perspective view showing an inner construction of a single pole switching unit for a circuit breaker to which a contactor assembly for a circuit breaker according to the present invention has been embodied.

FIG. 4 is a cut-perspective view showing an inner construction of a single pole switching unit for a circuit breaker to which a contactor assembly for a circuit breaker according to the present invention has been applied. As shown in FIG. 4, the contactor assembly for a circuit breaker according to the present invention can be embodied to a circuit breaker that a contactor assembly and an extinguishing mechanism provided according to each phase (in other words "each pole") are received in a mold case formed of an insulating material as a unit. The contactor assembly for a circuit breaker according to the present invention comprises a U-shaped (so called "a current limiting type") first fixed contactor 9 connected to a power source and having a contact 9*b* at one end thereof, and a U-shaped second fixed contactor 9' connected to an electric load and having a contact 9*b*' at one end thereof.

The contactor assembly for a circuit breaker according to the present invention comprises a movable contactor 4 having contacts 4*b* corresponding to the first fixed contactor 9 and the second fixed contactor 9' at both ends thereof, and movable to a contacted position to the first and second fixed contactors 9 and 9' or a separated position from the first and second fixed contactors 9 and 9'.

The contactor assembly for a circuit breaker according to the present invention comprises shafts 30 and 32 provided with an opening 33 for allowing independent rotating of the movable contactor 4 by an electromagnetic repulsive force between the movable contactor 4 and the first and second fixed contactors 9 and 9', for rotatably supporting the movable contactor 4.

The opening 33 for allowing independent rotating of the movable contactor 4 will be explained in more detail as follows. The movable contactor 4 is rotated by the following three methods. First, when a user shifts a handle, a switching mechanism connected to the handle rotates the shafts 30 and 32 and the movable contactor 4 is rotated by the rotation of the shafts 30 and 32.

Second, as a switching mechanism is interlocked (in other words "triggered") by an operation of a trip mechanism for detection of an abnormal current, the shafts 30 and 32 that support the movable contactor 4 is rotated and thus the movable contactor 4 is rotated.

Third, at the time of occurrence of a large current such as a short circuit, the movable contactor 4 is rotated by an electromagnetic repulsive force from the first and second fixed contactors 9 and 9' of a current limiting type. According to the third case, the movable contactor 4 is independently rotated from the rotation of the shafts 30 and 32.

The opening 33 indicates a space formed at the shafts 30 and 32 for allowing independent rotating of the movable contactor 4.

Referring to FIG. 4, an unexplained reference numeral 13 denotes an arc extinguishing mechanism for extinguishing arc gas generated when the movable contactor 4 is separated from the first and second fixed contactors 9 and 9'. Also, an unexplained reference numeral 20 denotes a stopper for limiting a rotation range of the movable contactor 4 when the movable contactor 4 is separated from the fixed contactors 9 and 9' thus to be rotated. Also, an unexplained reference numeral 21 denotes a single pole switching unit.

The contactor assembly provided at each single pole switching unit 21 will be explained with reference to FIGS. 5 and 6.

Figure 5:
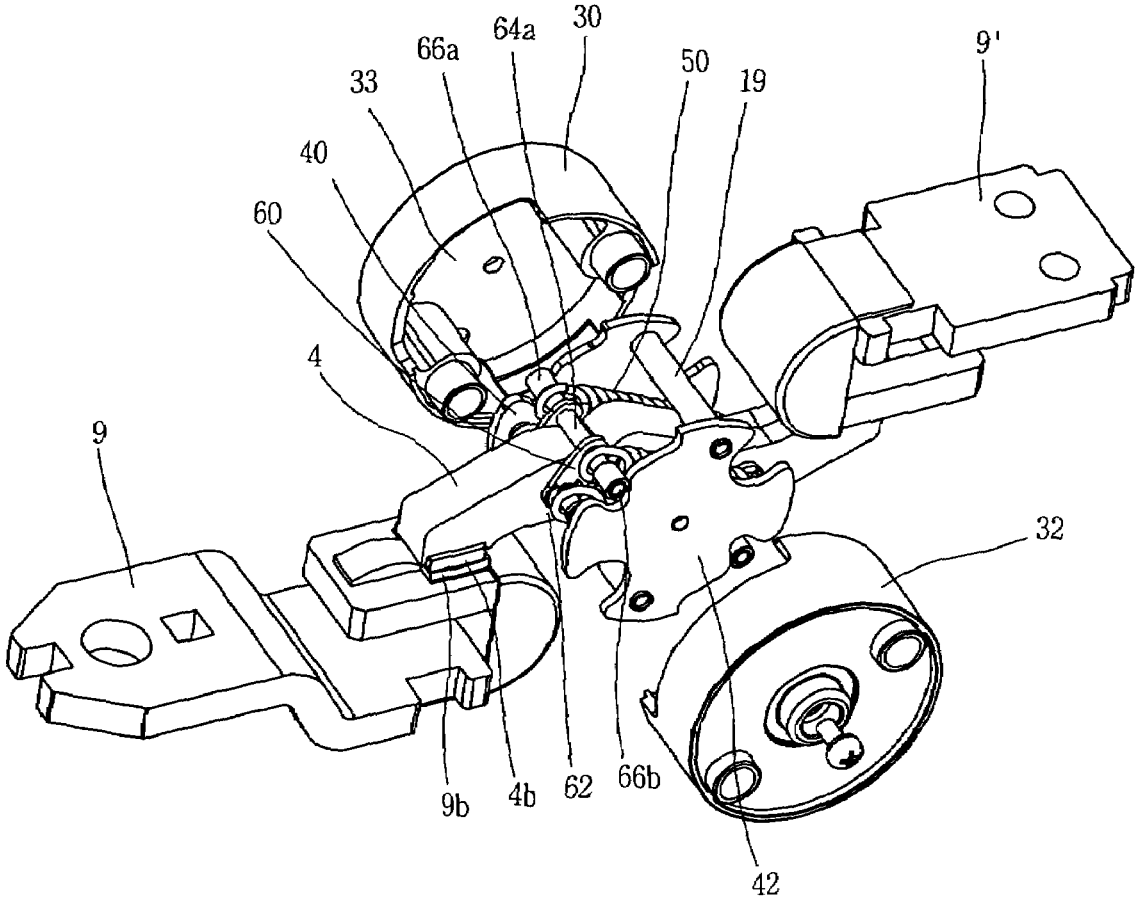
FIG. 5 is an exploded view showing a construction of the movable contactor assembly for a circuit breaker according to the present invention.
Figure 6:
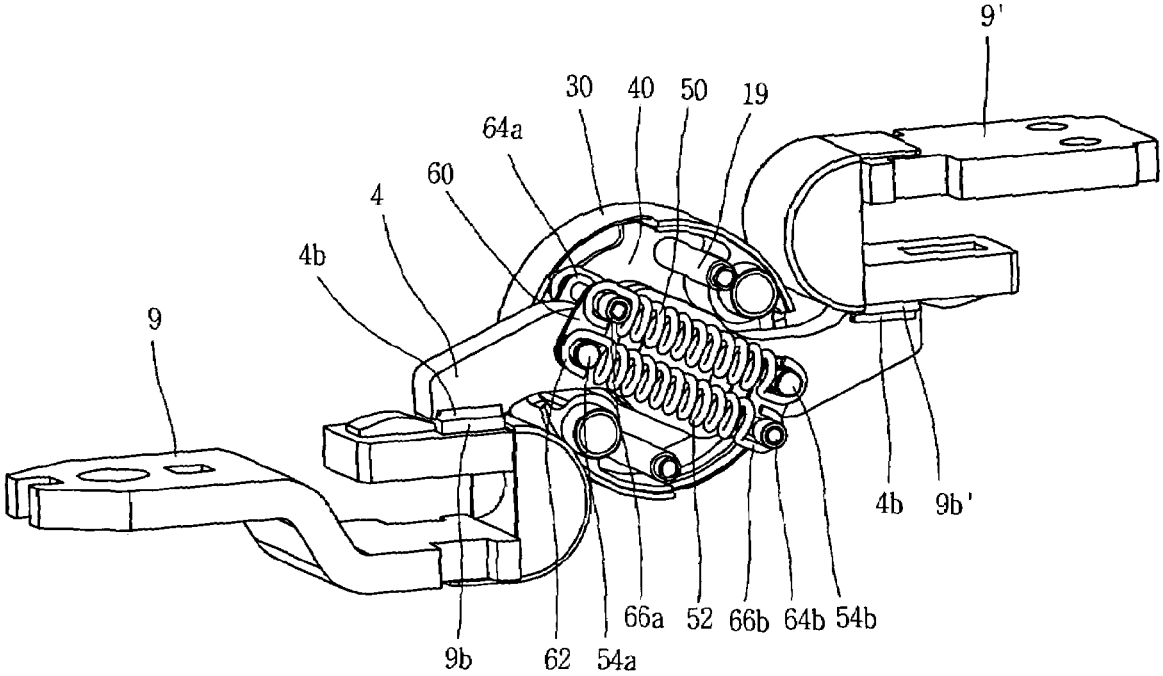
FIG. 6 is a cut-perspective view showing a half of a shaft of the contactor assembly for a circuit breaker according to the present invention.

As shown in FIG. 5, the shafts 30 and 32 are constructed as a pair. Each shaft 30 and 32 may be constructed to be separated from each other or to be coupled to each other.

Cam plates 40 and 42 each having an outer circumferential surface formed as a cam surface are fixed on the shafts 30 and 32 between the movable contactor 4. The cam surface is composed of a plurality of arc surfaces having different centers and radiuses. As shown in FIG. 6, between each cam plate 40 and 42 and the movable contactor 4, provided are a pair of first spring supporting pins 54*a* and 54*b* symmetrically fixed on both side surfaces of the movable contactor 4, a pair of symmetric second spring supporting pins 64*a* and 64*b*, links for connecting the first spring supporting pins 54*a* and 54*b* to the second spring supporting pins 64*a* and 64*b*, the links symmetrically arranged on each side of the movable contactor 4 as one pair, and springs 50 and 52 arranged on each side of the movable contactor as one pair, the spring having one end supported by the first spring supporting pins 54*a* and 54*b* and the other end supported by the second spring supporting pins 64*a* and 64*b*.

The second spring supporting pins 64*a* and 64*b* are provided with rollers 66*a* and 66*b* at both ends thereof for a smooth friction with the outer circumferential surface of the cam plates 40 and 42.

The space for receiving the springs 50 and 52, first spring supporting pins 54*a* and 54*b* and the links 60 is provided between the respective cam plates 40 and 42 and the movable contactor 4. Both ends of the respective second spring supporting pins 64*a* and 64*b*, that is, the rollers 66*a* and 66*b* are symmetrically arranged with a predetermined length for contacting the outer circumferential surface of each cam plate 40 and 42. A pair of separating pins 19 for separating the respective cam plates 40 and 42 from each other are provided.

Figure 7:
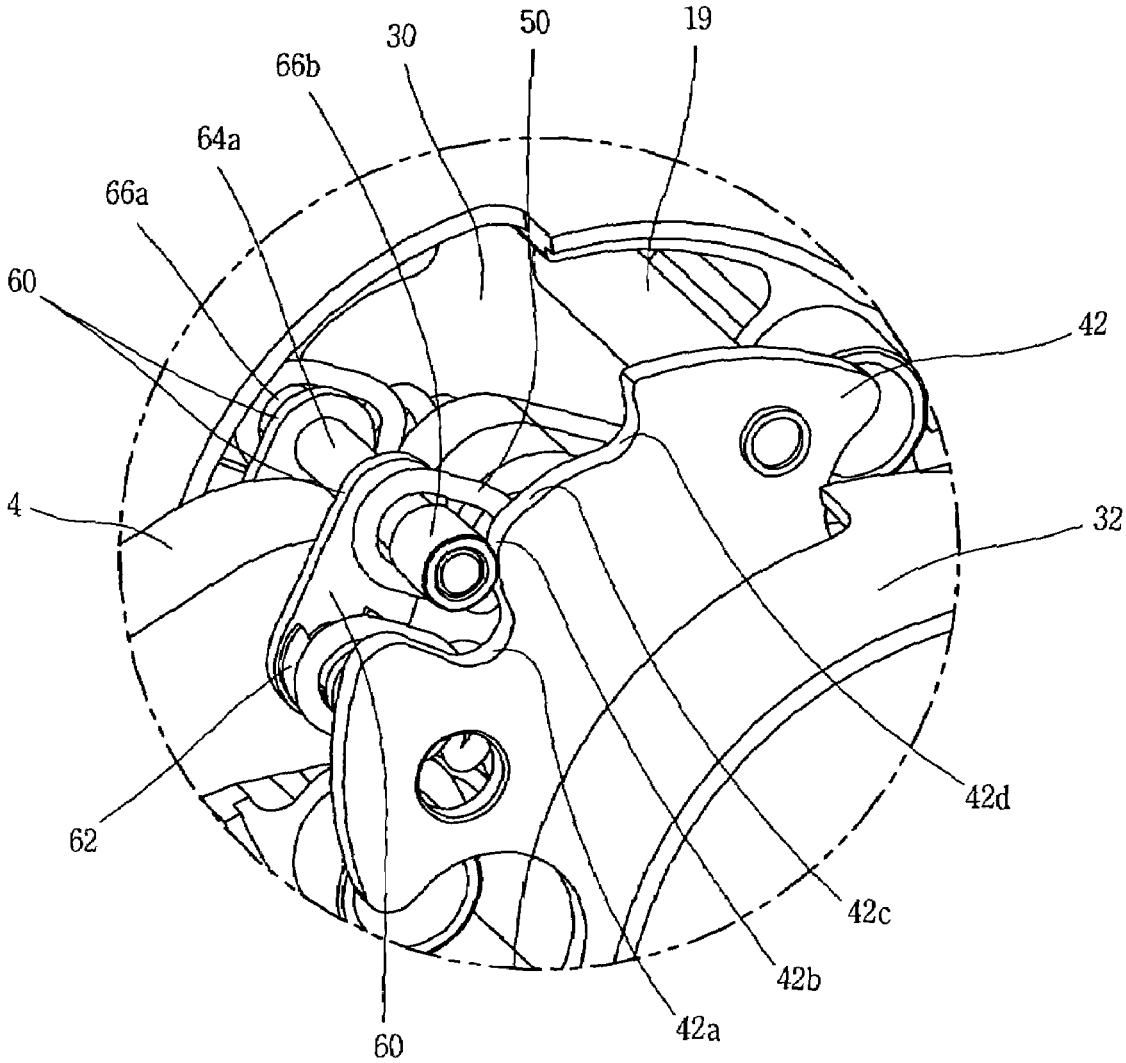
FIG. 7 is a partially enlarged view showing a cam plate and a second spring supporting pin of the contact assembly for a circuit breaker according to the present invention.

The construction of the cam plate and the second spring supporting pin of the contactor assembly according to the present invention will be explained in more detail with reference to FIG. 7.

Each cam surface of the cam plates 40 and 42 includes a first cam surface 42*b* having an arc center positioned at an inner side of the outer circumferential surface of the cam plates 40 and 42, a second cam surface 42*d* having an arc center positioned at an outer side of the outer circumferential surface, and a third cam surface 42*c* disposed between the first cam surface 42*b* and the second cam surface 42*d*, the third cam surface having an arc center positioned at an inner side of the outer circumferential surface. An unexplained reference numeral 42*a* denotes a landing groove for landing both ends of each second spring supporting pin 64*a* and 64*b*, that is, the rollers 66*a* and 66*b*. Also, an unexplained reference numeral 62 denotes an E ring.

Both ends of each second spring supporting pin 64*a* and 64*b*, that is, the rollers 66*a* and 66*b* come in contact with the first cam surface 42*b* of the cam plates 40 and 42 when the movable contactor 4 is in contact with the first and second fixed contactors 9 and 9'. When an electromagnetic repulsive force is generated between the movable contactor 4 and the first and second fixed contactors 9 and 9' due to an abnormal current such as a short circuit, both ends of each second spring supporting pin 64*a* and 64*b*, that is, the rollers 66*a* and 66*b* are together rotated along the movable contactor being rotated. Then, the rollers 66*a* and 66*b* are slid on the third cam surface 42*c* from the first cam surface 42*b* of the cam plates 40 and 42, and then come in contact with the second cam surface 42*d* for a predetermined time, thereby preventing the movable contactor 4 from returning towards the first and second fixed contactors 9 and 9'.

The springs 50 and 52 provide an elastic force in a direction to provide a contact pressure under a state that the movable contactor 4 is in contact with the first and second fixed contactors 9 and 9', and provide an elastic force in a direction to accelerate a separation of the movable contactor 4 from the first and second fixed contactors 9 and 9' when the second spring supporting pins 64*a* and 64*b* are slid on the third cam surface 42*c* as an electromagnetic repulsive force is generated between the movable contactor 4 and the first and second fixed contactors 9 and 9'.

An assembly process of the movable contactor assembly according to the present invention will be explained with reference to FIG. 8.

Figure 8:
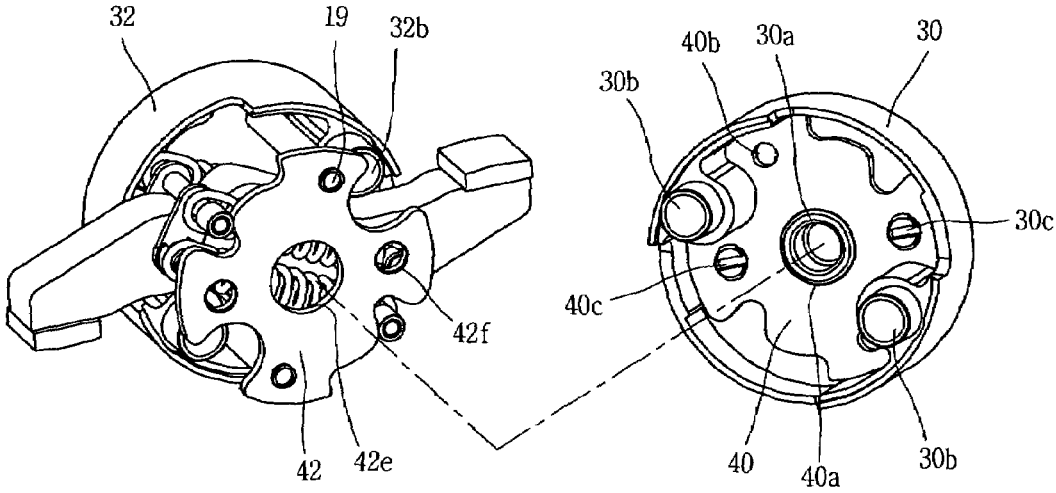
FIG. 8 is a view showing an assembly process of the movable contactor assembly according to the present invention.

As shown in FIG. 8, two hooks 30*c* for supporting the first cam plate 40 are protruding from an inner side surface of the first shaft 30, and a pair of hook holes 40*c* for inserting the hooks 30*c* are provided at the first cam plate 40. Two protrusions 30*b* for coupling the first shaft 30 to the second shaft 32 are provided on the inner side surface of the first shaft 30, and insertion holes 32*b* for inserting the protrusions 30*b* are provided on an inner side surface of the second shaft 32. Likewise, two hooks (not shown) having the same structure as that of the hooks 30*c* of the first shaft 30 for supporting the second cam plate 42 are protruding on the inner side surface of the second shaft 32. Hook holes 42*f* for inserting the hooks (not shown) are provided at the second cam plate 42. Two insertion holes 32*b* for inserting the protrusions 30*b* are provided on an inner side surface of the second shaft 32.

The first and second shafts 30 and 32 are formed of an electrical insulating material such as a resin. When the protrusions 30*b* of the first shaft 30 are inserted into the insertion holes 32*b* of the second shaft 32, a predetermined space is formed between the first shaft 30 and the second shaft 32 by the protrusions 30*b*. Accordingly, the cam plates 40 and 42 are fixed in the shafts 30 and 32, and are electrically insulated from outside.

As shown in FIG. 8, a central supporting portion 30*a* for supporting the first cam plate 40 is protruding at a central position of the inner side surface of the first shaft 30. Also, a central supporting portion hole 40*a* for inserting the central supporting portion 30*a* is provided at the first cam plate 40. A pair of separating pin holes 40*b* for inserting the separating pins 9 are facing to each other on one side of the central supporting portion hole 40*a* of the first cam plate 40. Also, a pair of hook holes 40*c* for inserting the hooks 30*c* are facing to each other on the other side of the central supporting portion hole 40*a* of the first cam plate 40.

Likewise, a central supporting portion (not shown) for supporting the second cam plate 42 is protruding at a central position of the inner side surface of the second shaft 32. Also, a central supporting portion hole 42*e* for inserting the central supporting portion is provided at the second cam plate 42. A pair of separating pin holes (not shown) for inserting the separating pins 9 are facing to each other on one side of the central supporting portion hole 42*e* of the second cam plate 42. Also, hook holes 42*f* for inserting hooks (not shown) formed on the inner side surface of the second shaft 32 are formed on another side of the central supporting portion hole 42*e* of the second cam plate 42. Even though the reference numerals 42, 42*e*, and 42*f* of FIG. 8 have to be depicted on a cam plate (not shown) corresponding to the second shaft 32, the reference numerals are depicted on a cam plate corresponding to the first cam plate 40 for convenience.

Referring to FIG. 8, an assembly process of the movable contactor assembly of the present invention will be explained as follows. As shown in FIG. 8, the two hooks 30*c* and the center supporting portion 30*a* of the first shaft 30 are respectively inserted into the hook holes 40*c* and the center supporting portion hole 40*a* of the first cam plate 40, thereby assembling the first shaft 30 and the first cam plate 40. Then, the first spring supporting pins 54*a* and 54*b*, the links 60, the E ring 62, the second spring supporting pins 64*a* and 64*b*, and the rollers 66*a* and 66*b* are respectively installed at the movable contactor 4, thereby it is ready to assemble the springs 50 and 52. Since the first spring supporting pins 54*a* and 54*b* are fixedly installed at the movable contactor 4, they may be protruding from the movable contactor 4 as a unit. Also, the first spring supporting pins 54*a* and 54*b* may be inserted onto each side of the movable contactor 4, or may forcibly penetrate the movable contactor by two penetration pins.

Then, the springs 50 and 52 are supported by the first spring supporting pins 54*a* and 54*b* and the second spring supporting pins 64*a* and 64*b*, thereby assembling the movable contactor 4 and the springs 50 and 52.

Then, the assembly of the movable contactor 4 and the springs 50 and 52 is assembled with the cam plate 40 so that one end of the second spring supporting pins 64*a* and 64*b*, that is, the roller 66*a* can be positioned on the first cam surface 42*b* of the first cam plate 40.

Next, one ends of the two separating pins 19 are inserted into the separating pin holes 40*b* of the first cam plate 40, and then another end of the second spring supporting pins 64*a* and 64*b*, or the roller 66*b* can be positioned on the first cam surface 42*b* of the second cam plate 42. Then, another ends of the two separating pins 19 are inserted into the separating pin holes 40*b* of the second cam plate 42, thereby assembling the movable contactor 4 and the springs 50 and 52 between the two cam plates 40 and 42.

Finally, the two hooks (not shown) and the center supporting portion (not shown) of the second shaft 32 are inserted into the two hook holes (not shown) and the center supporting portion hole (not shown) of the second cam plate 42, thereby completing the movable contactor assembly.

An operation of the movable contactor assembly for a circuit breaker according to the present invention will be explained with reference to FIGS. 9 to 11.

Figure 9:
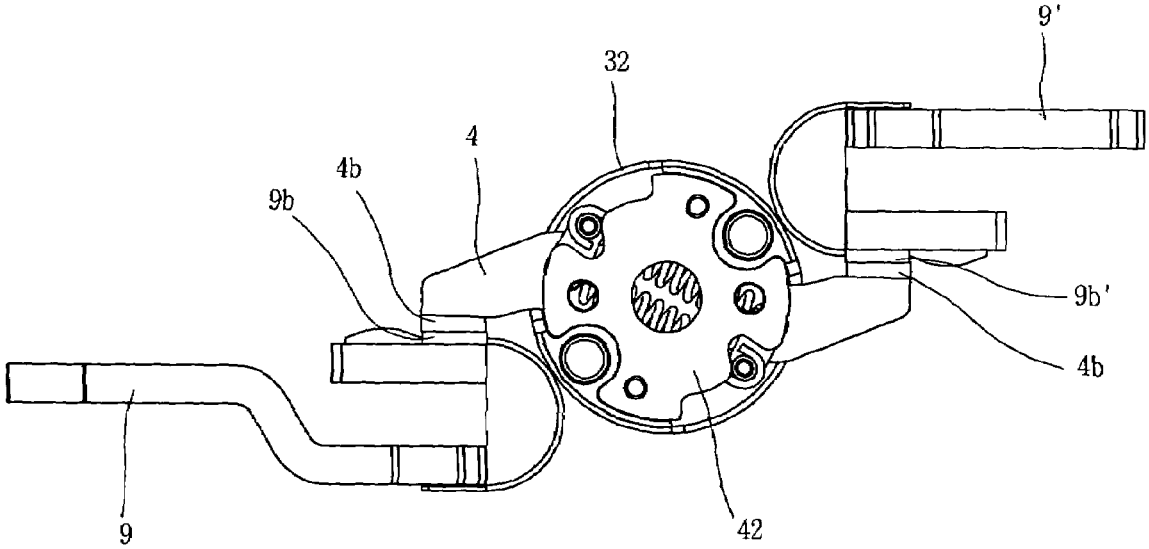
Figure 10:
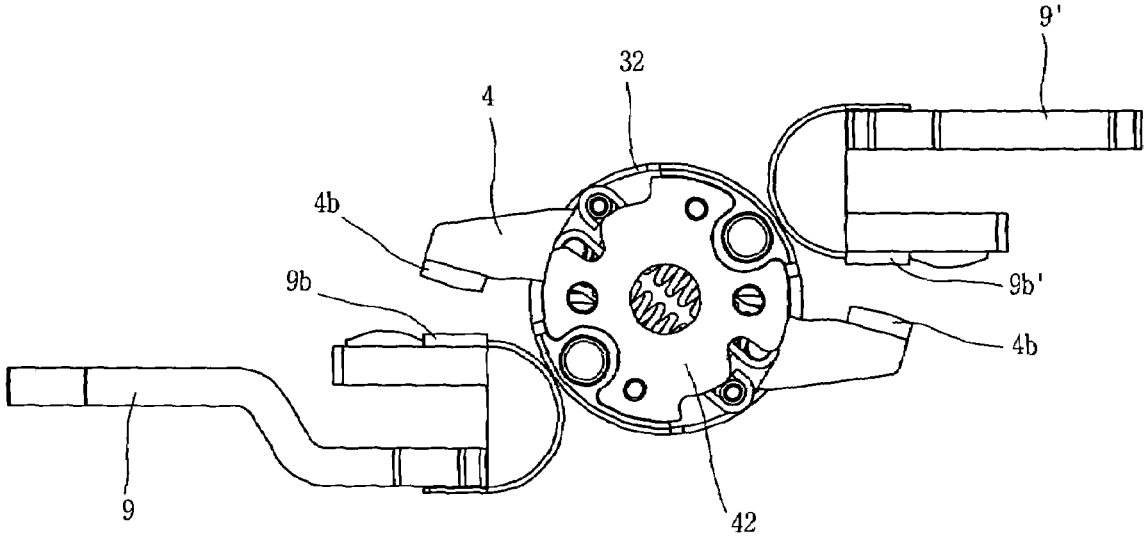
Figure 11:
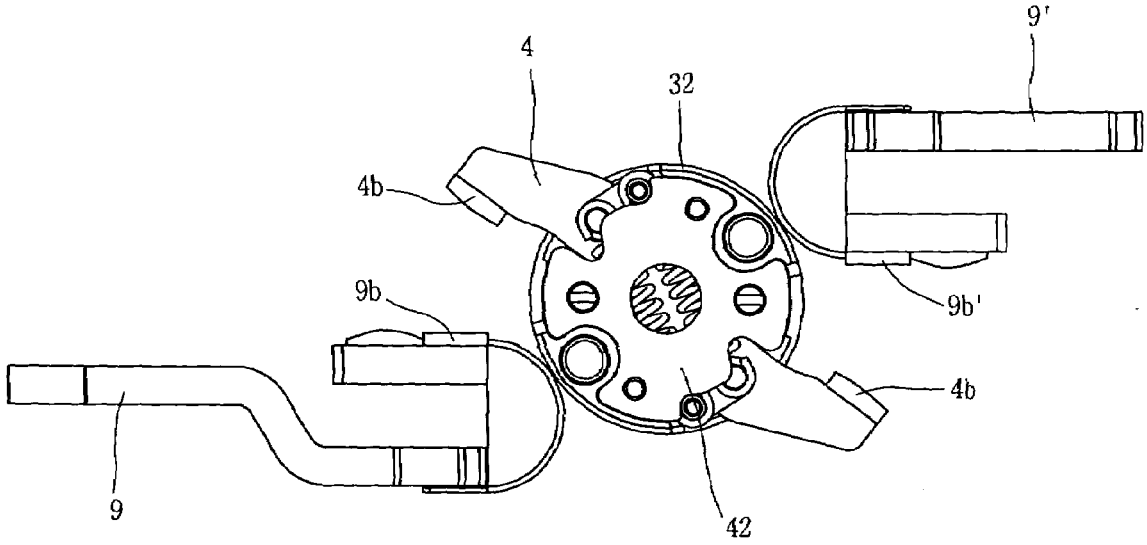

FIGS. 9 to 11 are sectional views showing an operation state of a movable contactor of the present invention, in which FIG. 9 shows a state that contacts are in contact with each other (a closed circuit state), FIG. 10 shows a state that the contacts are being separated from each other (an opened circuit state), and FIG. 11 shows that the separation of the movable contactor from the fixed contactors is completed.

The operation of the contactor assembly of the present invention can be largely divided into three, a closed state shown in FIG. 9, an opening state shown in FIG. 10, and an opened state shown in FIG. 11.

Referring to the closed state of FIG. 9, a current passes through the fixed contactor 9 and then passes through the fixed contactor 9' via the movable contactor 4.

Since an initial elastic energy of the springs 50 and 52 is applied to the movable contactor 4 as a counterclockwise rotation moment through the second spring supporting pins 64*a* and 64*b*, the movable contactor 4 maintains a constant contact pressure with the fixed contactor 9. When the cam plates 40 and 42 are counterclockwise rotated centering around a virtual rotation shaft with a predetermined angle thus to be fixed on the shafts 30 and 32, the contact pressure between the movable contactor 4 and the fixed contactor 9 is more increased. Accordingly, the contact pressure can be maintained even if the contacts are partially lost due to an arc of a high temperature and a high pressure after a short circuit or even if the contacts wear away. Under the state, the second spring supporting pins 64*a* and 64*b* are in contact with the first cam surface 42*b* of the cam plates 40 and 42.

The movable contactor 4 of the present invention can be supported by a self centering without a center axis by the cam plates 40 and 42 fixed on the shafts 30 and 32 and having a plurality of cam surfaces as an outer circumferential surface, the springs 50 and 52, the first spring supporting pins 54*a* and 54*b* fixed to the movable contactor 4, and the second spring supporting pins 64*a* and 64*b* slidable along the cam surfaces of the cam plates 40 and 42.

When an over-current occurs on the circuit, an electromagnetic repulsive force is generated between the movable contact 4*b* and the fixed contact 9*b*. Since the electromagnetic repulsive force is larger than the contact pressure at the time of occurrence of a large current such as a short circuit, the movable contactor 4 overcomes the contact pressure and rotated clockwise as shown in FIG. 10. At this time, both ends of the second spring supporting pins 64*a* and 64*b*, that is, the rollers 66*a* and 66*b* are together rotated along the movable contactor 4 being rotated. The rollers 66*a* and 66*b* are separated from the first cam surface 42*b* of the cam plates 40 and 42, and are slid on the third cam surface 42*c*. The springs 50 and 52 serve in a direction to accelerate the separation of the movable contactor 4 from the first and second fixed contactors 9 and 9', so that the separation between the contacts is instantaneously performed.

At a final stage of the separation, as shown in FIG. 11, the movable contactor 4 is completely separated from the fixed contactors 9 and 9'. Under the state, both ends of the second spring supporting pins 64*a* and 64*b*, or the rollers 66*a* and 66*b* are mounted on the second cam surface 42*d* having an arc center positioned at an outer side of the outer circumferential surface of the cam plates 40 and 42, thereby being stopped. Consequently, both ends of the second spring supporting pins 64*a* and 64*b*, or the rollers 66*a* and 66*b* are in contact with the second cam surface 42*d* for a predetermined time in order to prevent the movable contactor 4 from returning towards the fixed contactors 9 and 9'.

Then, the switching mechanism 12 is triggered by the trip mechanism 11 thus to rotate the shafts 30 and 32 clockwise, thereby tripping the circuit breaker.

As aforementioned, in the contactor assembly for a circuit breaker according to the present invention, the movable contactor has contacts at both ends thereof in order to maximize a current limiting function of the circuit breaker, thereby increasing an electromagnetic repulsive force. Also, since the initial elastic energy of the springs is applied to the movable contactor as a counterclockwise rotation moment through the second spring supporting pins under a closed circuit state, the movable contactor maintains a constant contact pressure with the fixed contactor. As the cam plates are counterclockwise rotated centering around a virtual rotation shaft with a predetermined angle thus to be fixed on the shafts, the contact pressure between the movable contactor and the fixed contactor is more increased. Accordingly, the contact pressure can be maintained even if the contacts are partially lost due to an arc of a high temperature and a high pressure after a short circuit or even if the contacts wear away.

The movable contactor of the present invention can be supported by a self centering without a center axis by the cam plates fixed on the shafts and having a plurality of cam surfaces as outer circumferential surfaces, the springs, the first spring supporting pins fixed to the movable contactor, and the second spring supporting pins slidable along the cam surfaces of the cam plates.

The outer circumferential surface of the cam plate to/on which the spring supporting pins contact/slide comprises a starting surface having an arc center positioned at an inner side of the outer circumferential surface, a separation accelerating surface having an arc center positioned at an inner side of the outer circumferential surface and connected to the starting surface, and a holding surface having an arc center positioned at an outer side of the outer circumferential surface. Accordingly, at the time of a normal current, the contact pressure is maintained, and at the time of an abnormal current that an electromagnetic repulsive force is greater than the contact pressure, the separation of the movable contactor from the fixed contactors is accelerated. Also, at the final stage of the current limiting operation, the movable contactor is prevented from returning towards the fixed contactors for a certain time thereby to maintain the separated position of the movable contactor from the fixed contactors until the circuit breaker is completely tripped.

Also, the spring supporting pins and the links are installed at the movable contactor, and then the springs are assembled to the spring supporting pins. Then, the cam plates are assembled to one side or both sides of the spring assembly, and the cam plates and the two shafts are assembled together as the holes are coupled to the supporting members, thereby easily assembling the movable contact assembly. Accordingly, even if small components such as the shaft for supporting the movable contactor with a diameter of several centimeters are applied to the circuit breaker of a small capacity, the components are assembled to one another with a small defective rate. Consequently, the circuit breaker having the contactor assembly corresponding to each phase and the single pole switching unit including the extinguishing mechanism can be made with more compact size than in the prior art, thereby enhancing the productivity and decreasing the defective rate.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A contactor assembly for a circuit breaker comprising:

a U-shaped first fixed contactor connected to a power source on an electric circuit;

a U-shaped second fixed contactor connected to an electric load on the circuit;

a movable contactor having contacts at both ends thereof, the contacts respectively corresponding to the first fixed contactor and the second fixed contactor, and movable to a contacted position to the first and second fixed contactors or a separated position from the first and second fixed contactors;

a shaft provided with an opening for allowing independent rotating of the movable contactor by an electromagnetic repulsive force between the movable contactor and the first and second fixed contactors, for rotatably supporting the movable contactor;

a pair of first spring supporting pins symmetrically fixed on both lateral surfaces of the movable contactor;

a cam plate positioned between the movable contactor and the shaft, fixed to the shaft, and having an outer circumferential surface formed as a cam surface composed of a plurality of arc surfaces having different centers and radiuses, wherein the cam surface includes a first cam surface having an arc center positioned at an inner side of the outer circumferential surface, a second cam surface having an arc center positioned at an outer side of the outer circumferential surface, and a third cam surface disposed between the first cam surface and the second cam surface, the third cam surface having an arc center positioned at an inner side of the outer circumferential surface;

a pair of symmetric second spring supporting pins contacting the first cam surface of the cam plate when the movable contactor is in contact with the first and second fixed contactors, and rotated along the movable contactor being rotated when an electromagnetic repulsive force is generated between the movable contactor and the first and second fixed contactors thereby to be slid on the third cam surface from the first cam surface of the cam plate and thus to be in contact with the second cam surface for a predetermined time, for preventing the movable contactor from returning towards the first and second fixed contactors;

a link for connecting the first spring supporting pins to the second spring supporting pins; and a spring having one end supported by the first spring supporting pins and the other end supported by the second spring supporting pins, for providing an elastic force so that a contact pressure between the movable contactor and the fixed contactors can be maintained under a state that the movable contactor is in contact with the first and second fixed contactors, and for providing an elastic force in a direction to accelerate a separation of the movable contactor from the first and second fixed contactors when the second spring supporting pins are slid on the third cam surface as an electromagnetic repulsive force is generated between the movable contactor and the first and second fixed contactors.

2. The contactor assembly for a circuit breaker of claim 1, wherein the second spring supporting pins are respectively provided with a roller at both ends thereof for smooth friction with the outer circumferential surface of the cam plate.

3. The contactor assembly for a circuit breaker of claim 1, wherein the springs are provided at each side of the movable contactor as one pair.

4. The contactor assembly for a circuit breaker of claim 1, wherein the cam plate is provided at each side of the movable contactor one to one.

5. The contactor assembly for a circuit breaker of claim 1, wherein the cam plate is formed of a metal material.

6. The contactor assembly for a circuit breaker of claim 1, wherein the shaft is constructed by coupling two separated bodies to each other.

7. The contactor assembly for a circuit breaker of claim 1, wherein the shaft and the cam plate are coupled to each other as a hole and a supporting member inserted into the hole are coupled to each other.

* * * * *